US010751732B2

(12) United States Patent
Yoshida

(10) Patent No.: US 10,751,732 B2
(45) Date of Patent: Aug. 25, 2020

(54) BUCKET FOR SWINGING ROTOR OF CENTRIFUGAL SEPARATOR

(71) Applicant: KUBOTA MANUFACTURING CORPORATION, Tokyo (JP)

(72) Inventor: Hideki Yoshida, Gunma (JP)

(73) Assignee: KUBOTA MANUFACTURING CORPORATION, Tokyo (JP)

( * ) Notice: Subject to any disclaimer, the term of this patent is extended or adjusted under 35 U.S.C. 154(b) by 287 days.

(21) Appl. No.: 15/737,694

(22) PCT Filed: Jun. 15, 2016

(86) PCT No.: PCT/JP2016/067789
§ 371 (c)(1),
(2) Date: Dec. 18, 2017

(87) PCT Pub. No.: WO2016/204175
PCT Pub. Date: Dec. 22, 2016

(65) Prior Publication Data

US 2018/0169667 A1 Jun. 21, 2018

(30) Foreign Application Priority Data

Jun. 19, 2015 (JP) ..... 2015-123564

(51) Int. Cl.
*B04B 5/04* (2006.01)

(52) U.S. Cl.
CPC .... *B04B 5/0421* (2013.01); *B04B 2005/0435* (2013.01)

(58) Field of Classification Search
CPC ..... B04B 5/0421; B04B 2005/0435
(Continued)

(56) References Cited

U.S. PATENT DOCUMENTS 5,855,289 A 1/1999 Moore
6,062,407 A 5/2000 Moore
(Continued)

FOREIGN PATENT DOCUMENTS

CN 1820857 A 8/2006
CN 102712001 A 10/2012
(Continued)

OTHER PUBLICATIONS

Office Action received for Japanese Patent Application No. 2015-123564, dated Jun. 25, 2019, 6 pages (3 pages of English Translation and 3 pages of Office Action).
(Continued)

*Primary Examiner* — Walter D. Griffin
*Assistant Examiner* — Shuyi S. Liu
(74) *Attorney, Agent, or Firm* — Womble Bond Dickinson (US) LLP

(57) ABSTRACT

There can be provided a bucket for a swinging rotor of a centrifugal separator that can be readily carried while ensuring the sealability at the time of a centrifugal treatment or the carriage operation. The bucket includes a bucket body (11) in a bottomed cylindrical shape, a cover main body (21) (cover), a packing (22) (seal member), and a pair of attachment mechanisms (34) configured to detachably attach the cover main body (21) to the bucket body (11). The cover main body (21) includes a lid portion (24) having clip fixing portions (31) (pressed portions) and configured to cover an opening (11*a*) of the bucket body (11), and a handle portion (25) formed integrally with the lid portion (24). The handle portion (25) is stretched between the pair of clip fixing portions (31). A handle concave portion (36) (hole) that opens toward the outside of the cover main body (21) and separates the lid portion (24) and the handle portion (25) is
(Continued)

formed between the lid portion (24) and the handle portion (25).

3 Claims, 13 Drawing Sheets

(58) Field of Classification Search
USPC ..... 494/16, 19, 20, 60
See application file for complete search history.

(56) References Cited

U.S. PATENT DOCUMENTS

| | | | | |
|---|---|---|---|---|
| 6,383,126 | B1 | 5/2002 | Fondin | |
| 2003/0119645 | A1 | 6/2003 | Hayward et al. | |
| 2005/0025674 | A1 | 2/2005 | Romanauskas et al. | |
| 2008/0045395 | A1* | 2/2008 | Romanauskas | B01L 9/06 494/40 |
| 2011/0136647 | A1* | 6/2011 | Piramoon | B04B 5/0421 494/20 |
| 2013/0116104 | A1* | 5/2013 | Koehn | B04B 7/08 494/60 |

FOREIGN PATENT DOCUMENTS

| | | | |
|---|---|---|---|
| DE | 69800873 | T2 | 9/2001 |
| DE | 102004036966 | | 3/2005 |
| DE | 69925402 | T2 | 2/2006 |
| DE | 102004062233 | | 7/2006 |
| DE | 60233975 | | 11/2009 |
| DE | 102013004357 | A1 | 9/2014 |
| EP | 0943370 | A2 | 9/1999 |
| EP | 1021250 | A1 | 7/2000 |
| EP | 1465736 | A2 | 10/2004 |
| EP | 2135679 | A1 | 12/2009 |
| GB | 0526399 | | 9/1940 |
| GB | 2421452 | A | 6/2006 |
| JP | H06-028198 | Y2 | 8/1994 |
| JP | 11-314657 | A | 11/1999 |
| JP | 2002-500552 | A | 1/2002 |
| JP | 2005-067737 | A | 3/2005 |
| JP | 2005-512786 | A | 5/2005 |
| JP | 2006-175440 | A | 7/2006 |
| JP | 2009-073570 | A | 4/2009 |
| JP | 2009-090291 | A | 4/2009 |
| WO | 98/48941 | A1 | 11/1998 |
| WO | 03/53589 | A2 | 7/2003 |

OTHER PUBLICATIONS

Supplementary European Search Report and Written Opinion received for EP Patent Application No. 16811649.9, dated Jan. 16, 2019, 7 pages.

International Search Report and Written Opinion received for PCT Patent Application No. PCT/JP2016/067789, dated Sep. 20, 2016, 15 pages (8 pages of English Translation and 7 pages of Original Document).

International Preliminary Report on Patentability received for PCT Patent Application No. PCT/JP2016/067789, dated Dec. 28, 2017, 13 pages (8 pages of English Translation and 5 pages of Original Document).

Office Action received for Chinese Patent Application No. 201680035124.0, dated Feb. 11, 2019, 12 pages (5 pages of English Translation and 7 pages of Office Action).

Office Action received for Chinese Patent Application No. 201680035124.0, dated Oct. 28, 2019, 8 pages (4 pages of English Translation and 4 pages of Office Action).

* cited by examiner

BUCKET FOR SWINGING ROTOR OF CENTRIFUGAL SEPARATOR

TECHNICAL FIELD

The present invention relates to a bucket for the swinging rotor of a centrifugal separator including a shield cover.

BACKGROUND ART

There is provided a swinging rotor as a rotor for a centrifugal separator. The swinging rotor is formed by a rotor yoke and a bucket. Tubes each containing a sample are inserted into the bucket, and the bucket is formed in a bottomed cylindrical shape and detachably and pivotably attached to the rotor yoke. The tubes are accommodated in the bucket while they are held in a rack. The bucket is swung up by the centrifugal force up to an angle of 0 to 90° along with the rotation of the rotor.

As described in, for example, patent literature 1, there is provided a bucket including a shield cover for sealing the interior of the bucket as this conventional type of bucket. The reason why the interior of the bucket is sealed is to prevent toxic bacteria, toxic substance, and the like from leaking outside the bucket and prevent other substances from entering the tubes without caps.

The shield cover described in patent literature 1 is formed in a shape that covers the opening of the bucket body in the bottomed cylindrical shape, and detachably attached to the bucket body by clip type fixing tools. A portion of the shield cover, which is mated with the bucket body, is provided with a seal member. When this seal member is sandwiched between the bucket body and the shield cover, the sealability is ensured.

To attach the shield cover to the bucket body, the clip type fixing tools described in patent literature 1 or screw type attachment structures are often used. The clip type fixing tools disclosed in patent literature 1 are each formed in a lever shape to be pivotably supported by the bucket body, and are formed to be engageable with the engaging portions of the shield cover. When the clip type fixing tools engage with the engaging portions of the shield cover, the shield cover is fixed to the bucket body.

With the screw type attachment structures, when each flange of the bucket body and a corresponding flange of the shield cover are fastened by a bolt while they are superimposed on each other, the shield cover is fixed to the bucket body. As the screw type attachment structure, there is also provided an attachment structure in which an external thread formed in the opening of one member among the shield cover and the bucket body threadably engage with an internal thread formed in the other member. In this case, the shield cover is attached/detached by rotating the shield cover with respect to the bucket body.

An operation of attaching the shield cover to the bucket body is performed in a so-called safety cabinet or the like. The safety cabinet indicates a simple work chamber having a working space as a negative pressure environment. To attach the shield cover to the bucket body, the tubes each containing the sample are accommodated in the bucket body together with the rack. Then, the bucket body is covered with the shield cover, and the shield cover is attached using the above-described attachment structures. By attaching the shield cover to the bucket body in this way, the interior of the bucket is sealed.

The centrifugal treatment of the samples is performed by carrying, from the safety cabinet to the rotor yoke, the bucket to which the shield cover is attached, and mounting the bucket on the rotor yoke. After the centrifugal treatment, the bucket detached from the rotor yoke is carried again to the safety cabinet, and the shield cover is then detached from the bucket body. During the centrifugal treatment or the carriage operation, it is necessary to ensure the sealability of the interior of the bucket. It is also important to readily carry the bucket.

RELATED ART LITERATURE

Patent Literature

Patent Literature 1: Japanese Utility Model Publication No. 06-028198

DISCLOSURE OF INVENTION

Problem to be Solved by the Invention

The bucket described in patent literature 1 has no handle that is gripped by the operator when carrying the bucket. Therefore, the bucket is held by the hands of the operator and carried. Since the bucket is formed in a bottomed cylindrical shape, it is difficult to hold and carry. Note that this carriage operation cannot be performed by holding the shield cover. The reason for this is that if a portion held by the operator is an unfixed portion away from the attachment structures, the shield cover is elastically deformed upward, and the sealability deteriorates due to a decrease in force that sandwiches the seal member.

The present invention has been made in consideration of the problem, and has as its object to provide a bucket for the swinging rotor of a centrifugal separator that can be readily carried while ensuring the sealability at the time of a centrifugal treatment or the carriage operation.

Means of Solution to the Problem

In order to achieve the above object of the present invention, there is provided a bucket for a swinging rotor of a centrifugal separator, comprising a bucket body in a bottomed cylindrical shape configured to accommodate a tube containing a sample to undergo a centrifugal treatment and pivotably and detachably supported by a rotor yoke of the centrifugal separator, a cover detachably attached to an opening of the bucket body and configured to close the opening, a seal member provided between the bucket body and the cover, and a pair of attachment mechanisms provided at positions that divide the opening into two parts and configured to detachably attach the cover to the bucket body while the cover is pressed toward the bucket body, the cover including a lid portion including a pair of pressed portions that are pressed by the pair of attachment mechanisms and configured to cover the opening, and a handle portion formed integrally with the lid portion and projecting from the lid portion toward an opposite side of the bucket body, wherein the handle portion is stretched between the pair of pressed portions, and a hole that opens toward the outside of the cover and separates the lid portion and the handle portion is formed between the lid portion and the handle portion.

Effect of the Invention

A bucket for the swinging rotor of a centrifugal separator according to the present invention can be readily carried by gripping a handle portion.

If the handle portion of a cover is gripped and lifted up while the cover is attached to a bucket body by attachment mechanisms, a downward force corresponding to the weight of the bucket body is applied to the pressed portions of the cover via the pair of attachment mechanisms. At this time, an upward force generated when the handle portion is lifted up is mainly applied to the pair of pressed portions since the transmission directions are restricted by a hole. The upward force applied to the pressed portions is canceled by the downward force corresponding to the weight of the bucket body, and thus the pressed portions are never deformed upward with respect to the bucket body.

Consequently, even if the bucket is lifted up by gripping the handle portion, it is possible to minimize a decrease in crushing amount of the seal member over the entire region of the cover, thereby suppressing a deterioration in sealability.

Since the handle portion is formed integrally with the lid portion of the cover, it never moves with respect to the lid portion at the time of a centrifugal treatment. Therefore, the force of each of the above-described attachment mechanisms, that presses the cover toward the bucket body, remains the same even during the centrifugal treatment.

According to the present invention, it is possible to provide a bucket for the swinging rotor of a centrifugal separator that can be readily carried while ensuring the sealability at the time of a centrifugal treatment or the carriage operation.

BEST MODE FOR CARRYING OUT THE INVENTION

An embodiment of a bucket for the swinging rotor of a centrifugal separator according to the present invention will be described in detail below with reference to FIGS. 1 to 12.

Figure 1:
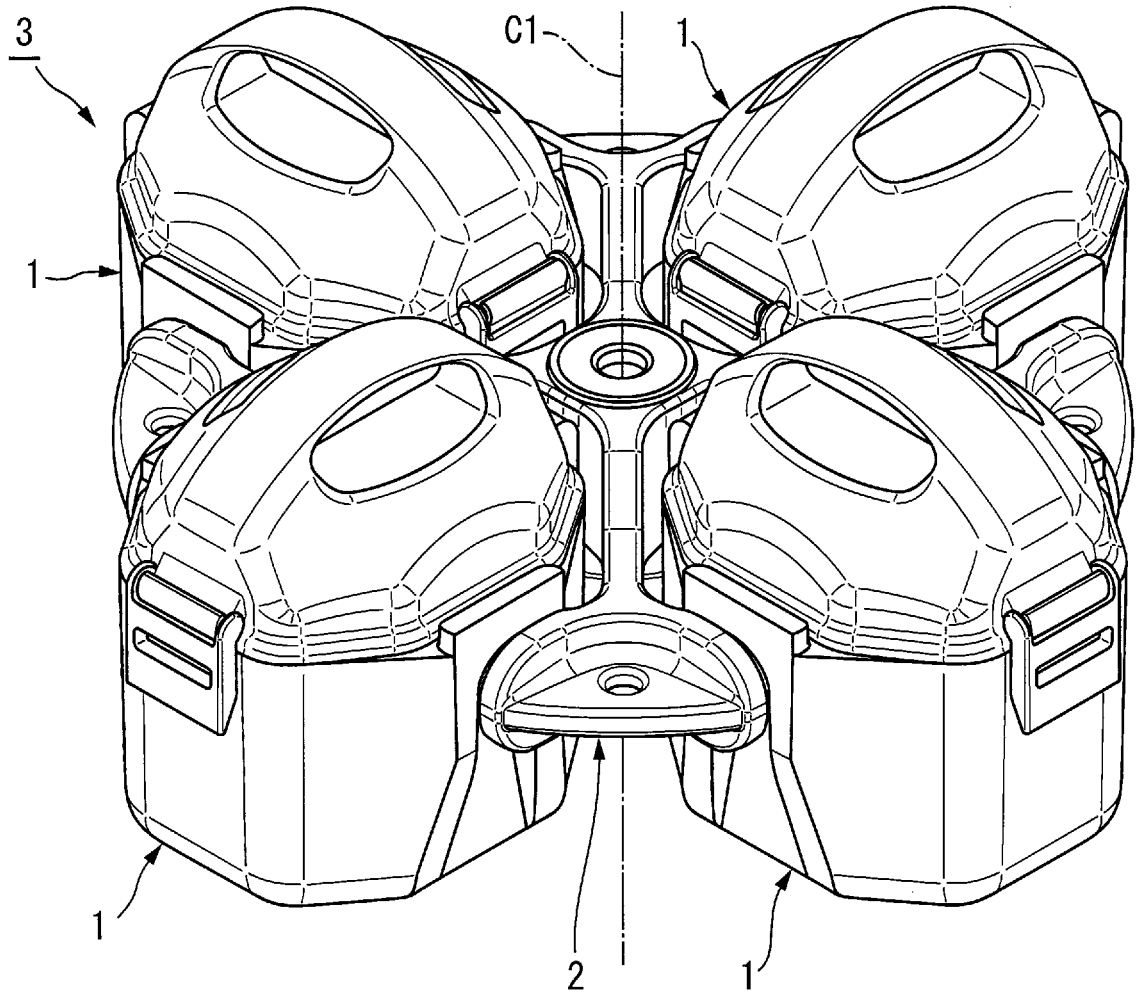
FIG. 1 is a perspective view showing a state in which buckets are mounted on a rotor yoke according to the present invention.

Four buckets 1 shown in FIG. 1 are supported by a rotor yoke 2. The four buckets 1 and the rotor yoke 2 form a swinging rotor 3 of a centrifugal separator (not shown). The rotor yoke 2 rotates about a rotation axis indicated by a one-dot dashed line C1 in FIG. 1. The rotation axis C1 extends in the vertical direction.

Figure 2:
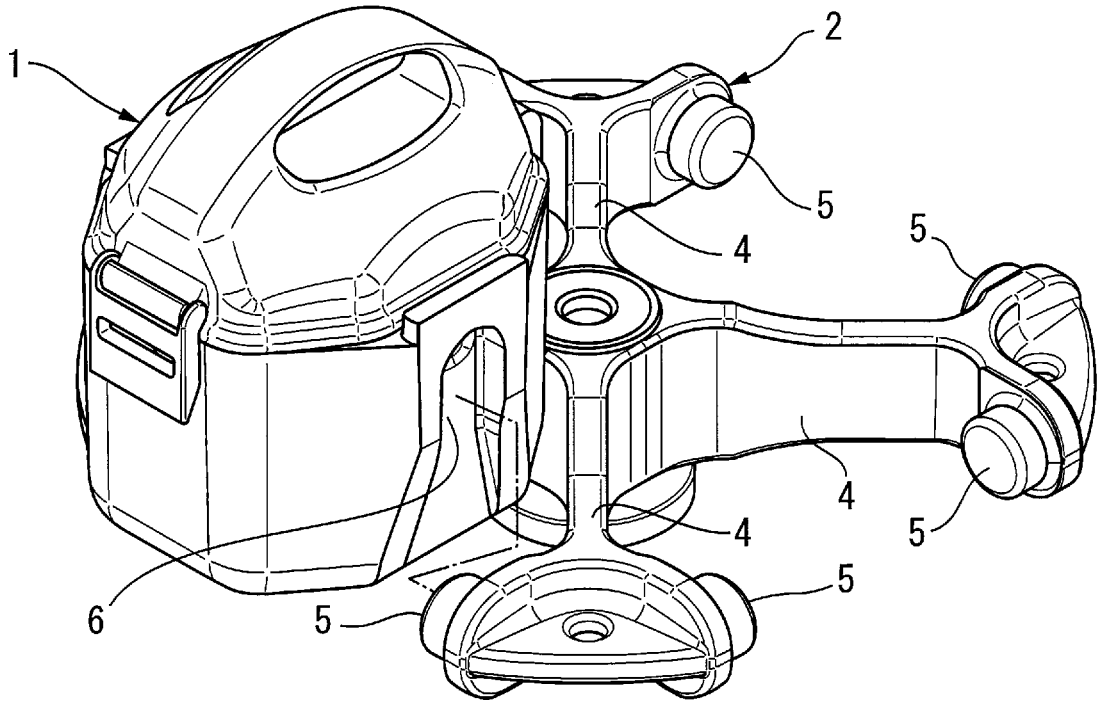
FIG. 2 is a perspective view showing a state in which the buckets are detached from the rotor yoke.

As shown in FIG. 2, the rotor yoke 2 includes four arms 4 each extending in the horizontal direction. Each of the distal end portions of the arms 4 is provided with trunnion pins 5. The trunnion pins 5 support the buckets 1 rotatably and detachably, and are each formed in a columnar shape. The trunnion pins 5 are rotatably fitted, from below, in trunnion pin grooves 6 (see FIG. 2) provided in two side portions of each bucket 1. If the rotor yoke 2 rotates at high speed while the buckets 1 are mounted on the rotor yoke 2, each bucket 1 rotates about the trunnion pins 5 by the centrifugal force acting on the bucket 1, and the bottom surface of the bucket 1 is swung up outward when viewed from the rotation center.

Figure 3:
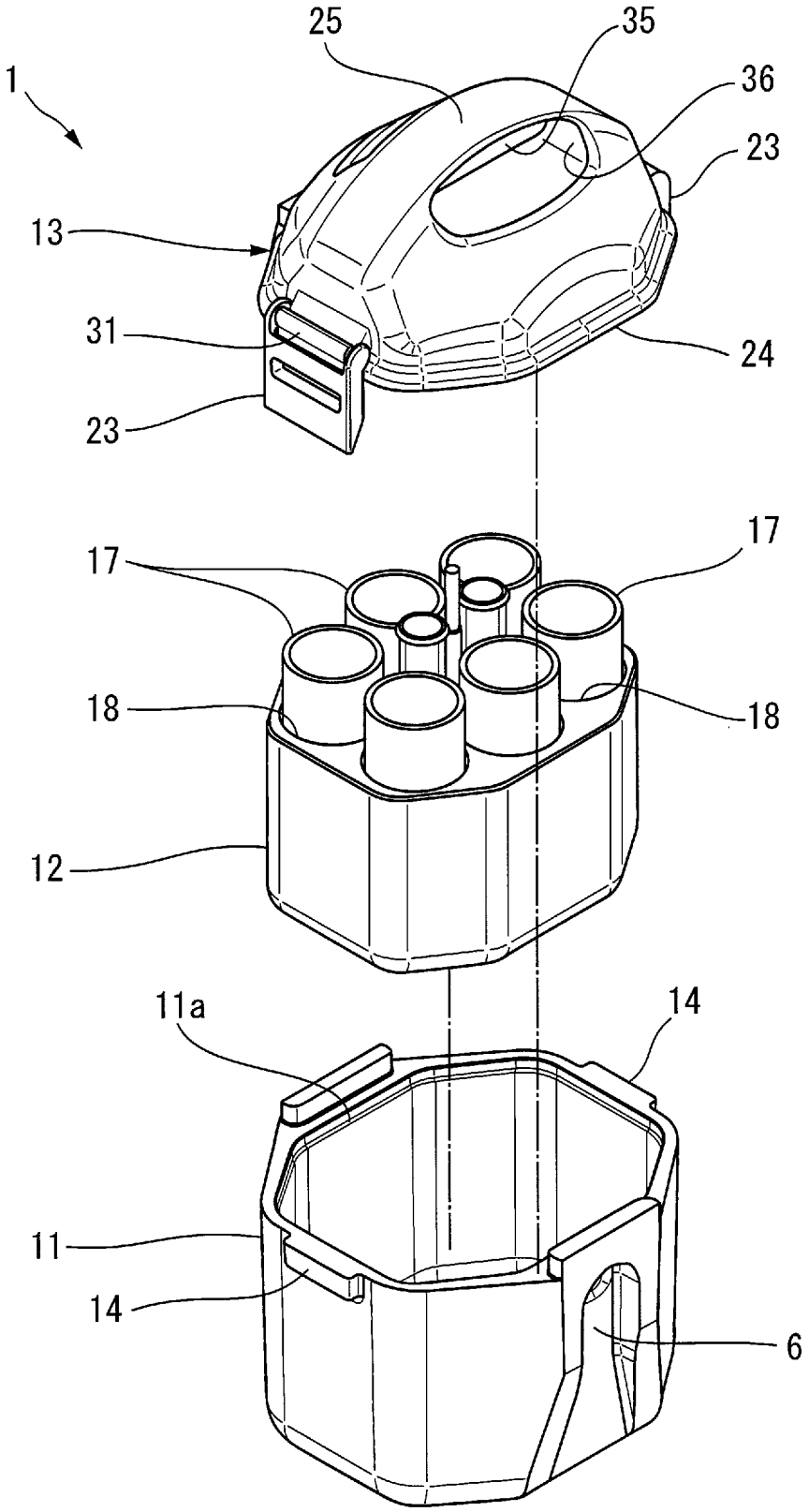
FIG. 3 is an exploded perspective view showing the bucket.

As shown in FIG. 3, each bucket 1 includes a bucket body 11 formed in a bottomed cylindrical shape, a tube rack 12 accommodated in the bucket body 11, and a shield cover 13 for closing an opening 11*a* of the bucket body 11. An explanation of each part of the bucket 1 assumes that a direction in which the bucket body 11 opens is set as an upward direction and a direction opposite to the direction is set as a downward direction.

Figure 4A:
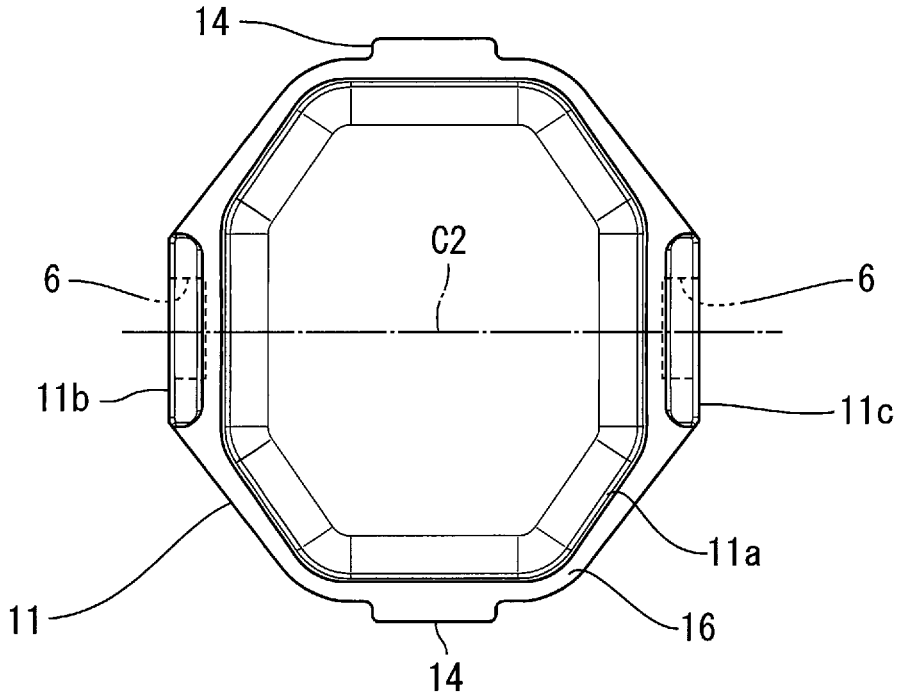
FIG. 4A is a plan view for explaining the arrangement of a bucket body.
Figure 4B:
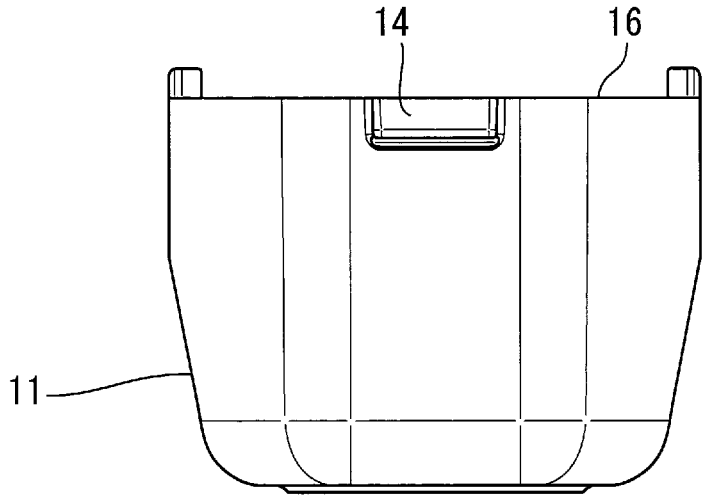
FIG. 4B is a front view for explaining the arrangement of the bucket body.
Figure 4C:
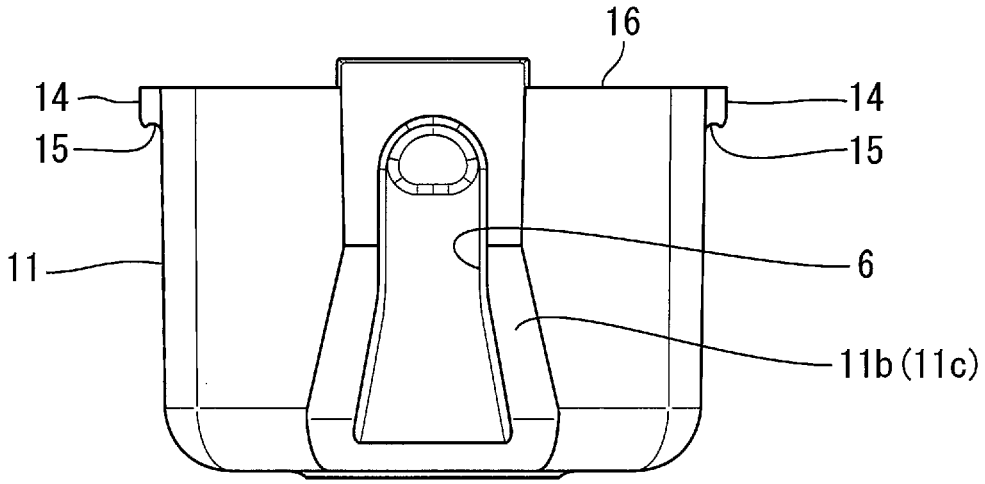
FIG. 4C is a side view for explaining the arrangement of the bucket body.

As shown in FIGS. 4A to 4C, the bucket body 11 includes the above-described trunnion pin grooves 6 located on the outer portion and a pair of engaging convex portions 14 located near the opening 11*a*. The trunnion pin grooves 6 are provided in two facing side walls 11*b* and 11*c* of the bucket body 11, respectively. As shown in FIG. 4C, the trunnion pin grooves 6 extend in the vertical direction along the side walls 11*b* and 11*c* of the bucket body 11, and open laterally and downward with respect to the bucket body 11. The direction in which the two trunnion pin grooves 6 are formed is the axial direction of the trunnion pins 5. The axial direction of the trunnion pins 5 is indicated by a one-dot dashed line C2 in FIG. 4A.

The engaging convex portions 14 are used to fix the shield cover 13 (to be described later) to the bucket body 11, and are respectively provided at positions at which the bucket body 11 is divided (halved) into two parts in the axial direction of the trunnion pins 5 when viewed from above. In other words, as shown in FIG. 4C, the positions at which the engaging convex portions 14 are provided are the positions of the two end portions of the bucket body 11 when viewed from a direction facing the trunnion pin groove 6 (the axial direction of the trunnion pins 5). The direction in which the pair of engaging convex portions 14 are arranged will be simply referred to as "the radial direction of the rotor 3" hereinafter.

Each engaging convex portion 14 projects laterally from the bucket body 11, and is formed in a shape extending in a direction orthogonal to the radial direction of the rotor 3. As shown in FIG. 4C, the lower end of each engaging convex portion 14 is formed by a bucket hook groove 15. The bucket hook groove 15 has an arc-shaped cross section that is convex upward. The bucket hook groove 15 forms an "engaging portion" of the invention.

A flat mating surface 16 extending in the horizontal direction is formed in the opening 11*a* of the bucket body 11. This mating surface 16 is formed over the entire region of the opening 11*a* of the bucket body 11 without any discontinuity.

As shown in FIG. 3, the tube rack 12 is used to hold a plurality of tubes 17. Each tube 17 is formed in a bottomed cylindrical shape, and contains a sample (not shown). The tube rack 12 according to this embodiment is formed in a shape fitted inside the bucket body 11. The tube rack 12 includes six non-through holes 18 for tube insertion to hold the six tubes 17. The tubes 17 are inserted into the non-through holes 18 from above, and held.

Figure 5:
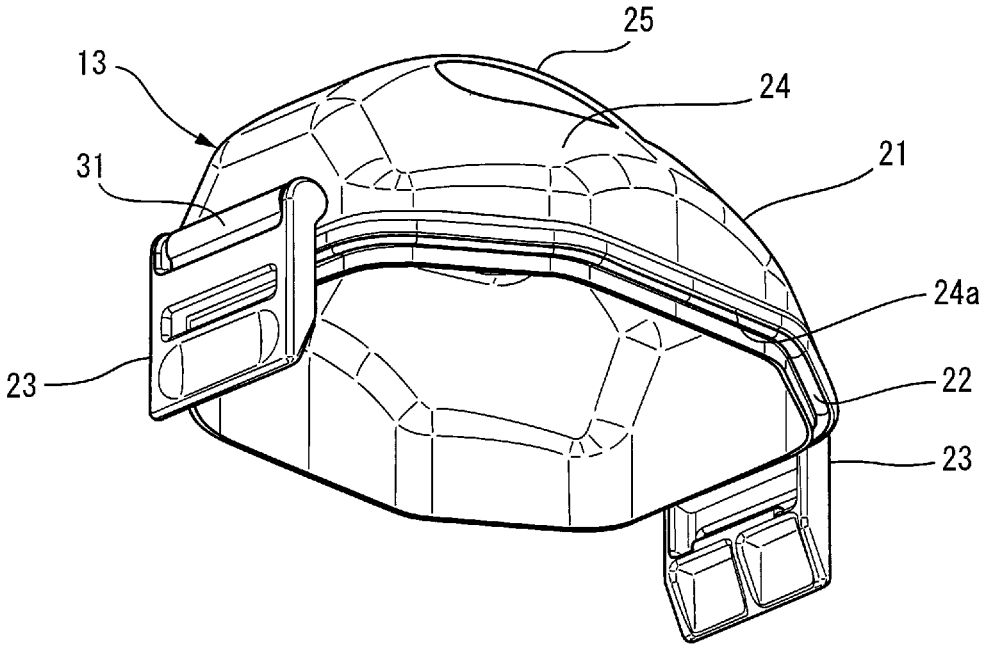
FIG. 5 is a perspective view showing a shield cover when viewed from diagonally below.
Figure 6:
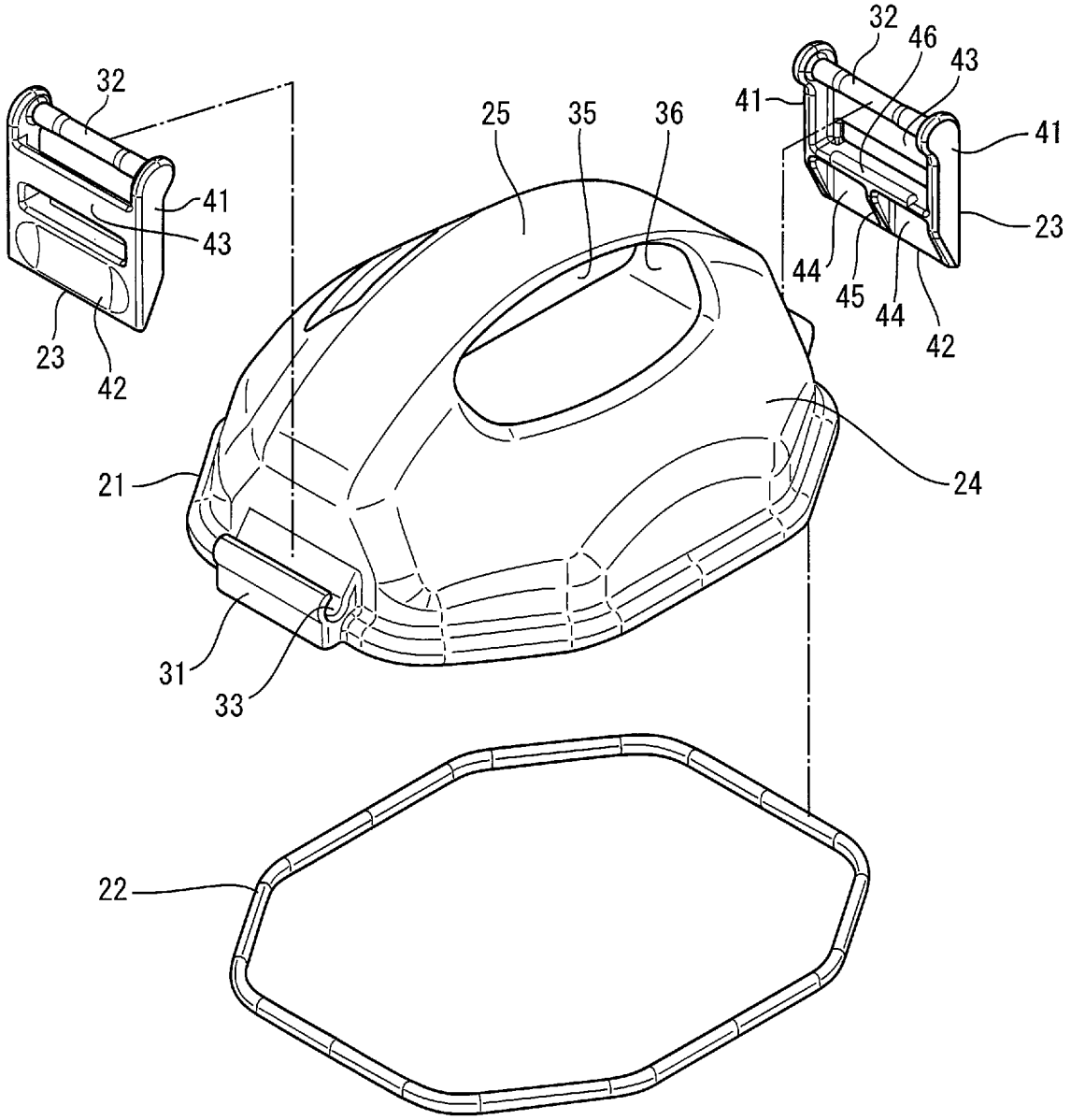
FIG. 6 is an exploded perspective view showing the shield cover.

As shown in FIGS. 5 and 6, the shield cover 13 is formed by a cover main body 21, a packing 22 attached to the lower end portion of the cover main body 21, clip type fixing tools 23 (to be simply referred to as clips 23 hereinafter) pivotably attached to the two end portions of the cover main body 21, and the like.

As shown in FIGS. 7A to 7E, the cover main body 21 includes a lid portion 24 for covering the opening 11*a* of the bucket body 11, and a handle portion 25 projecting upward (to the opposite side of the bucket body 11) from the lid portion 24. In this embodiment, the cover main body 21 forms a "cover" of the present invention.

The cover main body 21 according to this embodiment is formed in a predetermined shape by a plastic material. Thus, the handle portion 25 is formed integrally with the lid portion 24.

Figure 7A:
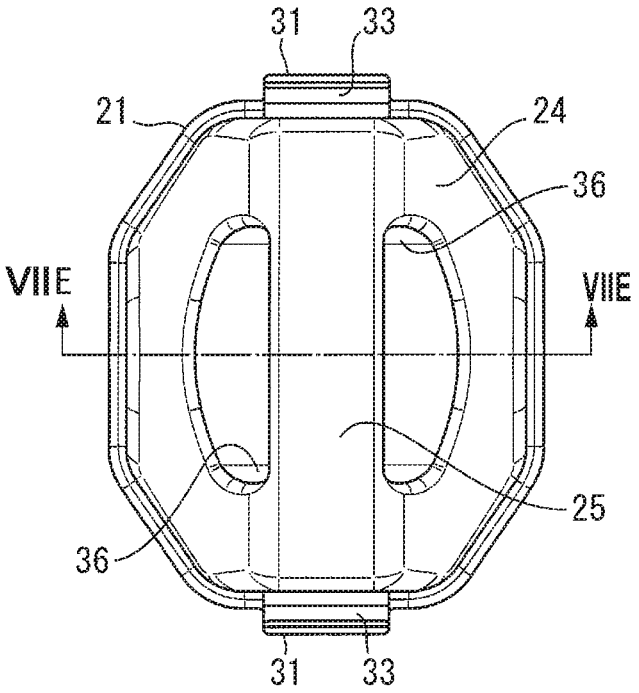
FIG. 7A is a plan view for explaining the arrangement of a cover main body.
Figure 7B:
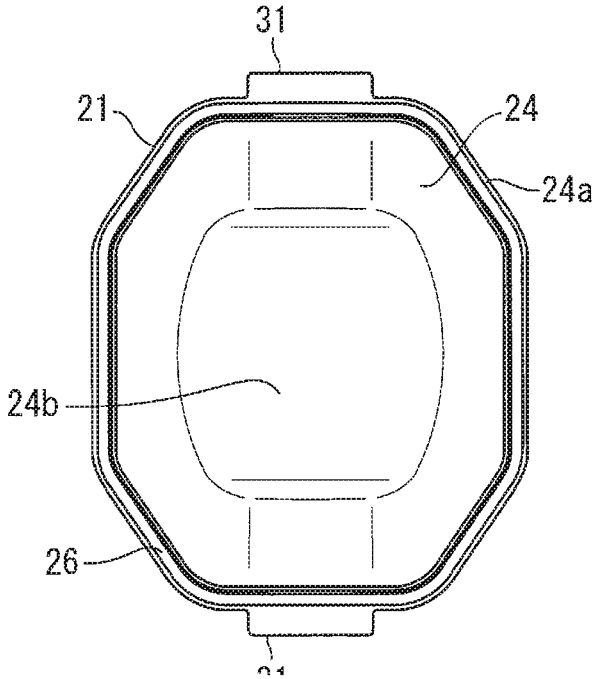
FIG. 7B is a bottom view for explaining the arrangement of the cover main body.
Figure 7C:
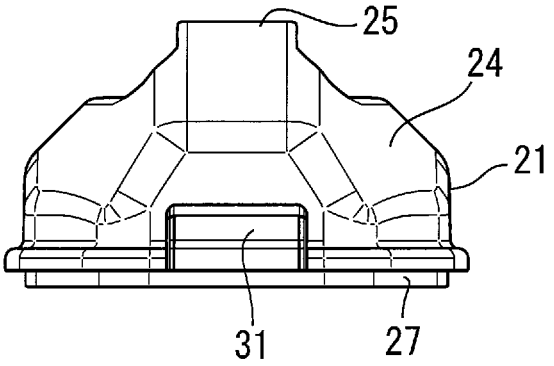
FIG. 7C is a front view for explaining the arrangement of the cover main body.
Figure 7D:
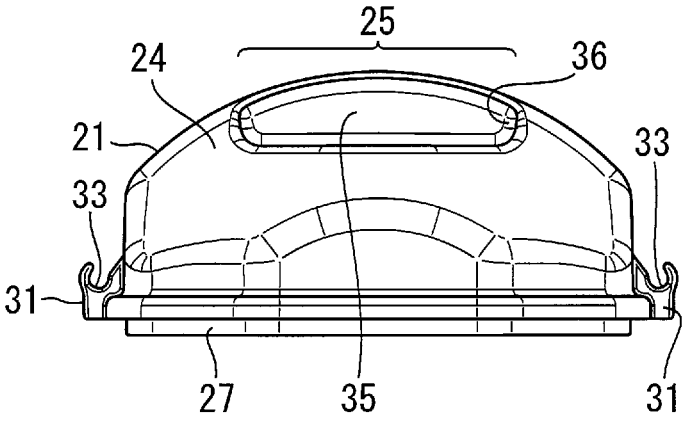
FIG. 7D is a side view for explaining the arrangement of the cover main body.
Figure 7E:
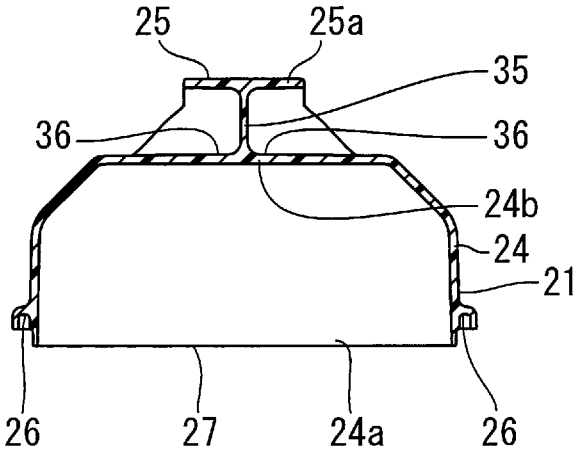
FIG. 7E is a sectional view taken along a line E-E in FIG. 7A.
Figure 7F:
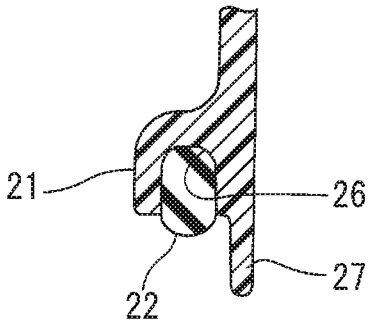
FIG. 7F is an enlarged sectional view showing a packing holding portion.

As shown in FIG. 7E, the lid portion 24 is formed in a box shape opening downward. As shown in FIGS. 7B and 7F, a concave groove 26 for holding the packing 22 and a projection 27 extending downward from the concave groove 26 are formed in the opening 24*a* of the lid portion 24. The concave groove 26 opens downward, and extends over the entire region of the opening 24*a* of the lid portion 24 without any discontinuity.

The packing 22 inserted into the concave groove 26 is formed by an elastic body such as rubber in an annular shape (see FIG. 6) that can be fitted in the concave groove 26. As shown in FIG. 7F, the packing 22 is formed in a shape in which the lower end portion of the packing 22 protrudes downward from the concave groove 26 while the packing 22 is inserted into the concave groove 26. The packing 22 is in contact with the mating surface 16 of the bucket body 11 while the shield cover 13 is attached to the bucket body 11. In this embodiment, the packing 22 forms a "seal member" of the present invention.

Figure 9:
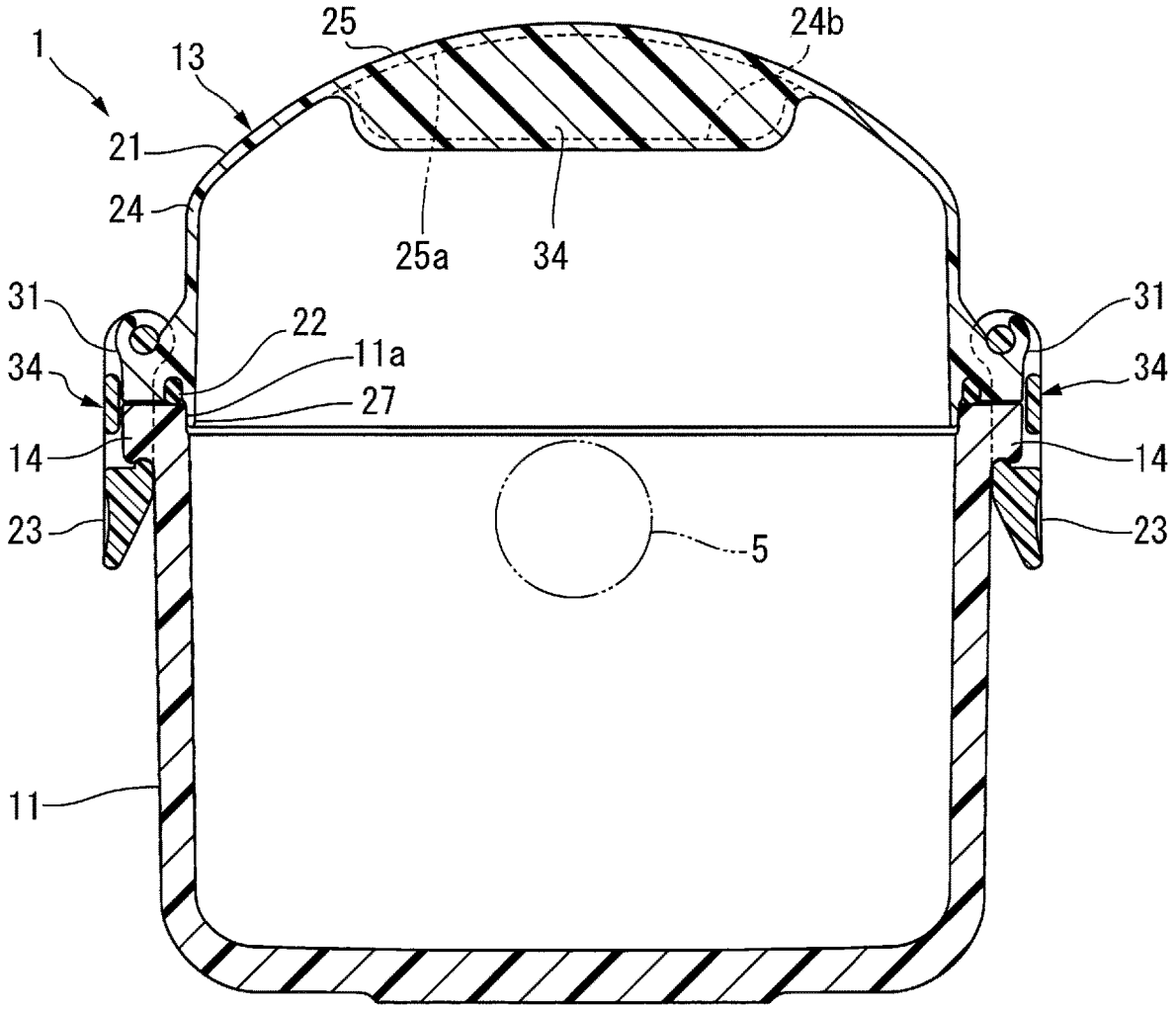
FIG. 9 is a sectional view showing the bucket.

The projection 27 extends over the entire region of the opening 11*a* of the lid portion 24 without any discontinuity. As shown in FIG. 9, the projection 27 is fitted in the opening 11*a* of the bucket body 11 while the shield cover 13 is attached to the bucket body 11.

Clip fixing portions 31 are provided in the two end portions of the lid portion 24 in the radial direction of the rotor 3 (the two end portions in the vertical direction in FIG. 7A). Each clip fixing portion 31 has a function of pivotably holding the clip 23 (to be described later).

The clip fixing portions 31 according to this embodiment are provided near the opening 24*a*, and project from the two sides of the lid portion 24 in the radial direction of the rotor 3. The upper portion of each clip fixing portion 31 is formed by a concave groove 33 in which a clip shaft portion 32 (see FIG. 8A) of the clip 23 is pivotably fitted. The concave groove 33 is formed to have a C-shaped cross section that opens upward.

Although details will be described later, each clip 23 forms an attachment mechanism 34 (see FIG. 9) together with the corresponding engaging convex portion 14 of the bucket body 11. The attachment mechanism 34 has a function of detachably attaching the cover main body 21 to the bucket body 11 and a function of pressing the cover main body 21 toward the bucket body 11. Consequently, the clip fixing portions 31 of the cover main body 21 are pressed downward by the attachment mechanisms 34. In this embodiment, the clip fixing portions 31 form "pressed portions" of the present invention.

As shown in FIGS. 7A and 7D, the handle portion 25 is stretched between the pair of clip fixing portions 31. As shown in FIG. 7E, the handle portion 25 according to this embodiment is formed by a plate-like upper plate 25*a* extending to connect the pair of clip fixing portions 31 and a vertical wall 35 connecting the upper plate 25*a* to an upper wall 24*b* of the lid portion 24. As shown in FIG. 7D, the upper plate 25*a* is formed to have an arc-shaped cross section that is convex upward (toward the opposite side of the bucket body 11) when viewed from the axial direction of the trunnion pins 5.

The vertical wall 35 is located in the central portions of the upper wall 24*b* and upper plate 25*a* in the axial direction of the trunnion pins 5 (in the horizontal direction in FIG. 7E), and extends in the vertical direction and the radial direction of the rotor 3. Consequently, a handle concave portion 36 opening toward one side and the other side in the axial direction of the trunnion pins 5 is formed between the upper plate 25*a* and the upper wall 24*b* of the lid portion 24. The handle concave portion 36 opens toward the outside of the cover main body 21, and separates the lid portion 24 and the handle portion 25. In this embodiment, the handle concave portion 36 corresponds to a "hole" of the present invention, and the vertical wall 35 corresponds to a "wall connecting a lid portion and a handle portion" of the invention.

The center of the arc formed by the upper plate 25*a* is the axis of the trunnion pins 5 when viewed from the axial direction of the trunnion pins 5.

As shown in FIGS. 6 and 8A to 8E, each clip 23 includes the clip shaft portion 32 formed in a columnar shape, and a pair of side plate portions 41 connected to the two end portions of the clip shaft portion 32, and first and second clip joining portions 42 and 43 provided between the side plate portions 41. The clip 23 according to this embodiment is formed in a predetermined shape by a plastic material.

The clip shaft portion 32 is formed in a shape rotatably fitted in the above-described concave groove 33 of the clip fixing portion 31, and is connected to the one-end portions of the side plate portions 41. The first clip joining portion 42 is connected to the other-end portions of the side plate portions 41. The second clip joining portion 43 is located between the clip shaft portion 32 and the first clip joining portion 42.

Two concave portions 44 are formed in the first clip joining portion 42 so that the operator (not shown) inserts fingers. The concave portions 44 are formed between the pair of side plate portions 41 and a reinforcing rib 45 located at the central portion of the first clip joining portion 42.

Figure 8A:
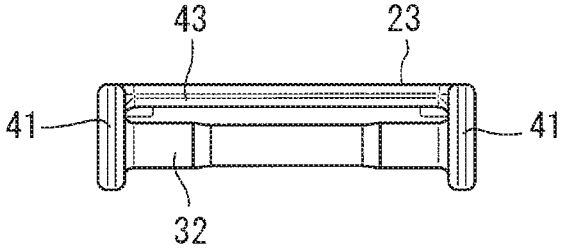
FIG. 8A is a plan view for explaining the arrangement of a lever.
Figure 8B:
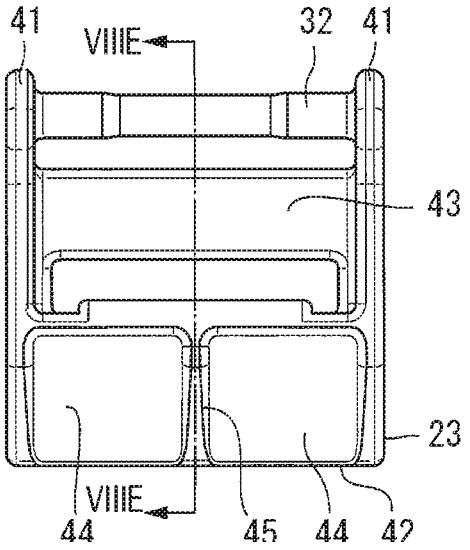
FIG. 8B is a front view for explaining the arrangement of the lever.
Figure 8C:
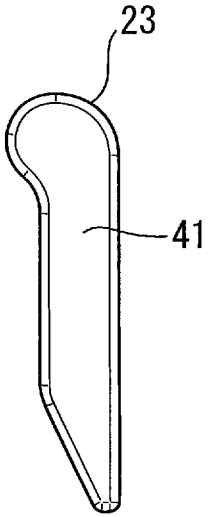
FIG. 8C is a side view for explaining the arrangement of the lever.
Figure 8D:
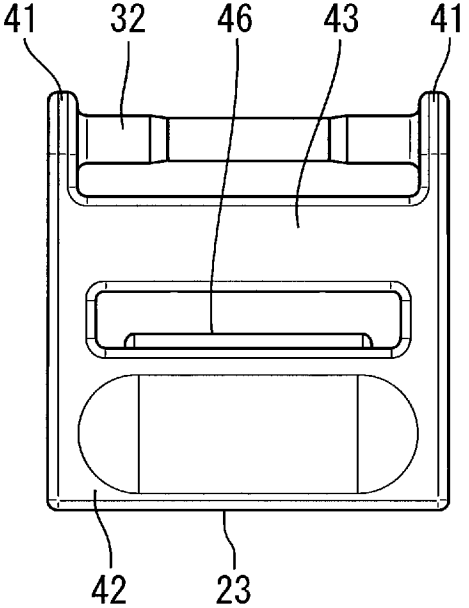
FIG. 8D is a rear view for explaining the arrangement of the lever.
Figure 8E:
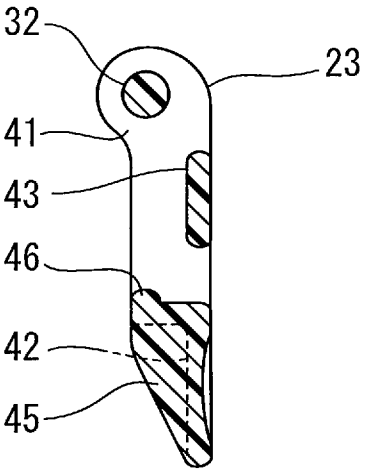
FIG. 8E is a sectional view taken along a line E-E in FIG. 8B.
Figure 10A:
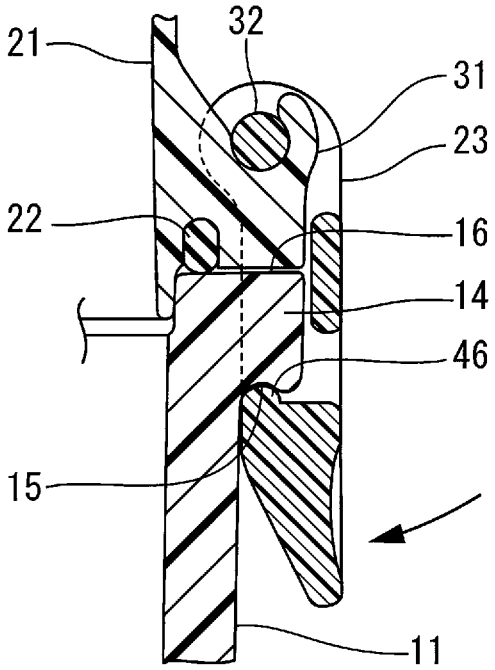
FIG. 10A is a sectional view showing an attachment structure in a locked state.
Figure 10B:
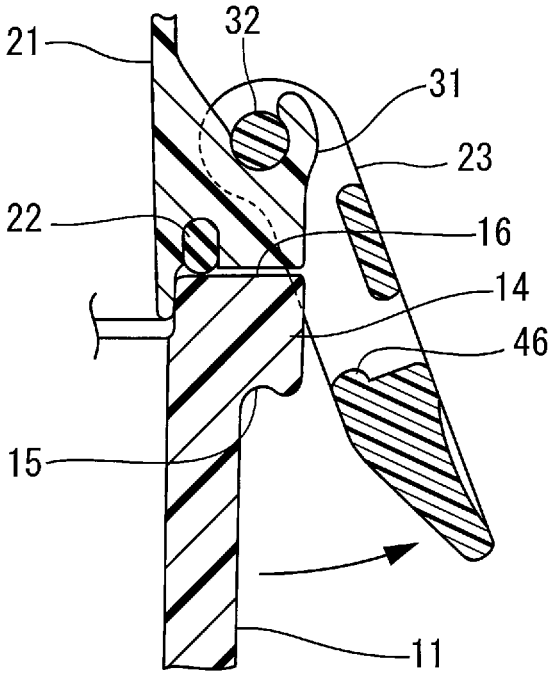
FIG. 10B is a sectional view showing the attachment structure in an unlocked state.

A clip hook portion 46 is provided in a portion of the first clip joining portion 42 facing the second clip joining portion 43 to project. As shown in FIG. 8E, the clip hook portion 46 is formed to have a semicircular cross section that is convex toward the clip shaft portion 32. As shown in FIGS. 10A and 10B, the clip hook portions 46 are located at positions where the clip hook portions 46 are engaged in the bucket hook grooves 15 by superimposing the cover main body 21 attached with the clips 23 on the bucket body 11 and swinging the clips 23 toward the bucket body 11. An arrangement in which the engagement displaces the cover main body 21 to the side of the bucket body 11 to compress the packing 22 is adopted. A state in which the clip hook portions 46 are engaged in the bucket hook grooves 15 to compress the packing 22, as shown in FIG. 10A, will be referred to as a locked state hereinafter. Furthermore, a state in which the clip hook portions 46 are not engaged in the bucket hook grooves 15, as shown in FIG. 10B, will be referred to as an unlocked state hereinafter.

To attach the shield cover 13 having the above arrangement to the bucket body 11, the shield cover 13 is superimposed on the opening 11*a* of the bucket body 11 so that the projection 27 of the cover main body 21 is fitted in the bucket body 11. At this time, the packing 22 is in contact with the mating surface 16 of the bucket body 11. Then, the operator swings the clips 23 to fit and engage the clip hook portions 46 in the bucket hook grooves 15 of the bucket body 11, as shown in FIGS. 9 and 10A.

When the clip hook portions 46 are engaged in the bucket hook grooves 15, the cover main body 21 is fixed to the bucket body 11 and the shield cover 13 is set in the locked state. This engagement causes the cover main body 21 to press the packing 22 toward the bucket body 11, and the packing 22 is compressed and crushed as a whole.

When the opening 11*a* of the bucket body 11 is covered with the shield cover 13 and the packing 22 is compressed between the bucket body 11 and the shield cover 13, the interior of the bucket 1 is sealed.

To detach the shield cover 13 from the bucket body 11, the operator swings each clip 23 in a direction in which the swing end portion of the clip 23 is separated from the bucket body 11, as shown in FIG. 10B. When the clips 23 were swung, the engagement between the clip hook portions 46 and the bucket hook grooves 15 is canceled, thereby setting the shield cover 13 in the unlocked state. In this state, the shield cover 13 is lifted up from the bucket body 11, thereby detaching the shield cover 13 from the bucket body 11.

The bucket 1 in a state in which the shield cover 13 is fixed to the bucket body 11 and set in the locked state can be readily carried by gripping the handle portion 25 of the shield cover 13. The handle portion 25 is gripped when the operator inserts fingers into the handle concave portion 36 to hook them on the upper plate 25*a*. At this time, the cover main body 21 is applied with an upward force generated when the handle portion 25 is lifted up and a downward force corresponding to the weight of the bucket 1 and transmitted via the clips 23.

Figure 11:
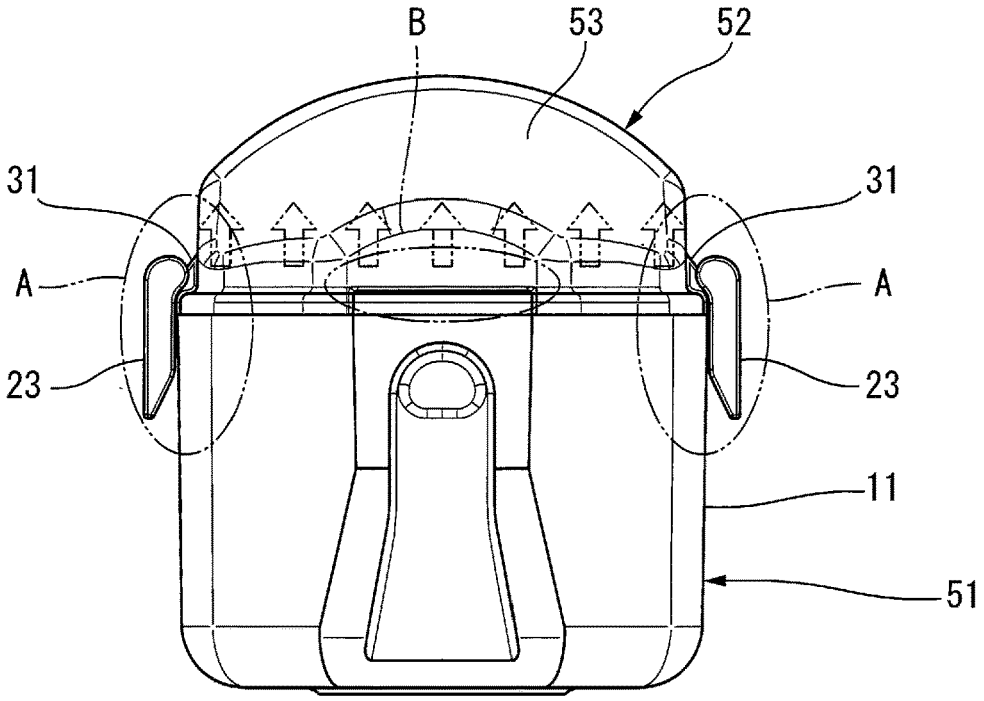
FIG. 11 is a side view showing a bucket according to a comparative example in which no handle portion is provided.

The reason why the sealability deteriorates when a bucket provided with no handle portion is carried will be described again with reference to FIG. 11. In FIG. 11, the same reference numerals as in FIGS. 1 to 10B denote the same or equivalent members. As for a bucket 51 provided with no handle portion, as described in patent literature 1, if a shield cover 52 is lifted up, an upward force almost uniformly acts on the entire region of a cover main body 53, as indicated by arrows in FIG. 11. Since the cover main body 53 is not a complete rigid body, it is deformed when an external force is applied.

The peripheral portions of the clip fixing portions 31 pressed toward the bucket body 11 by the clips 23, that is, portions A indicated by two-dot dashed lines in FIG. 11 have relatively small deformation amounts, a decrease in crushing amount of the packing 22 is small. However, in an unfixed portion that receives no force from each clip 23, that is, a portion B indicated by a two-dot dashed line in FIG. 11, the crushing amount of the packing 22 largely decreases. Thus, the sealability unwantedly deteriorates.

Figure 12:
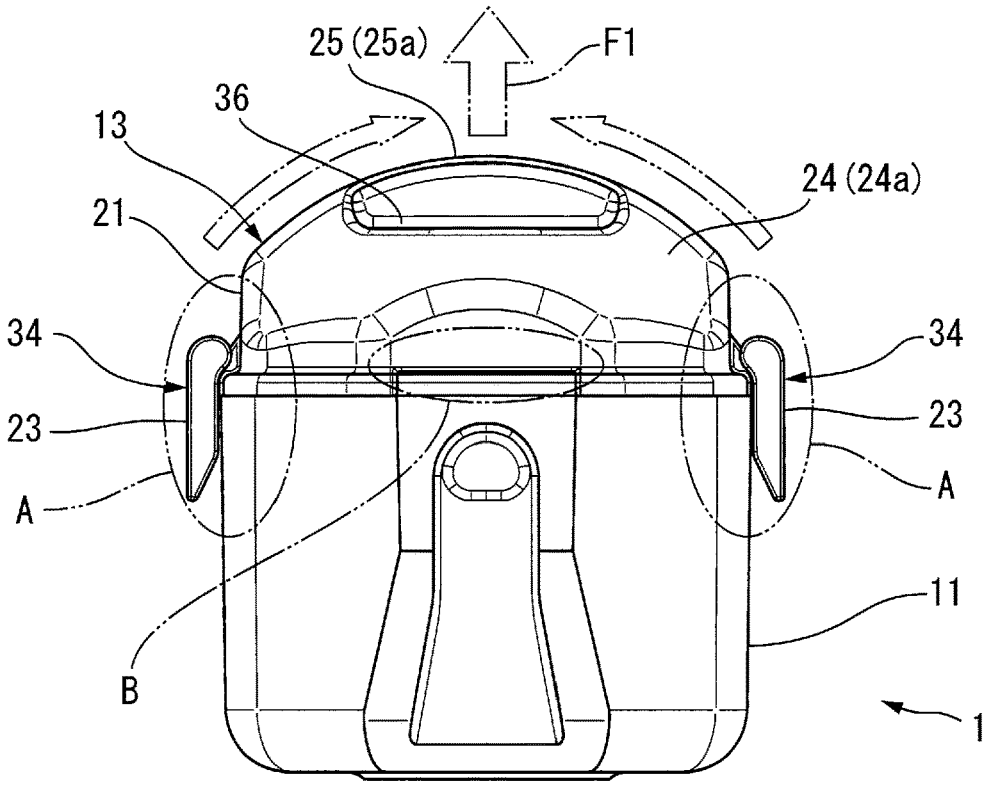
FIG. 12 is a side view showing the bucket according to the present invention for explaining a state at the time of a carriage operation.

To the contrary, as for the bucket 1 according to this embodiment, if a force F1 that lifts up the handle portion 25 is applied to the handle portion 25, as shown in FIG. 12, the force F1 intensively acts on the peripheral portions (portions A) of the clip fixing portions 31 for the first and second reasons (to be described later). The first reason is that the handle portion 25 is stretched between the pair of clip fixing portions 31 and the upper plate 25*a* of the handle portion 25 extends to the clip fixing portions 31. The second reason is that the handle concave portion 36 is formed between the handle portion 25 and the lid portion 24, and the force is difficult to be transmitted between the upper plate 25*a* of the handle portion 25 and the upper wall 24*b* of the lid portion 24. That is, the transmission direction of the upward force is restricted by the handle concave portion 36.

Consequently, most of the force that lifts up the handle portion 25 acts on the peripheral portions of the clip fixing portions 31, and the upward force transmitted to the unfixed portion (portion B) that is not fixed by the clips 23 is small. Since the upward force applied to the clip fixing portions 31 is canceled by the downward force corresponding to the weight of the bucket body 11, the clip fixing portions 31 are never deformed upward with respect to the bucket body 11.

Therefore, even if the bucket 1 is lifted up by gripping the handle portion 25, it is possible to minimize a decrease in packing crushing amount over the entire region of the cover main body 21, thereby suppressing a deterioration in sealability.

Since the handle portion 25 is formed integrally with the lid portion 24 of the cover main body 21, it never moves with respect to the lid portion 24 at the time of the centrifugal treatment. Therefore, the force of each of the above-described attachment mechanisms 34, that presses the cover main body 21 toward the bucket body 11, remains the same during the centrifugal treatment.

According to this embodiment, it is possible to provide a bucket for the swinging rotor of a centrifugal separator that can be readily carried while ensuring the sealability at the time of a centrifugal treatment or the carriage operation.

In the bucket 1 according to this embodiment, the handle portion 25 is formed integrally with the lid portion 24, and the locked state and the unlocked state of the cover main body 21 can be switched by the dedicated attachment mechanism 34 irrelevant to the handle portion 25. Although not shown, for example, the reliability when ensuring the sealed state is high, as compared with a case in which the locked state and the unlocked state of the cover main body are switched by making the handle portion pivotably provided in the cover main body stand upright or tilting the handle portion. The reason for this is that if a centrifugal treatment is performed in a state in which the handle portion stands upright with respect to the cover main body (in a state at the time of the carriage operation), the handle portion may tilt due to the centrifugal force. To solve this problem, it is only necessary to adopt an arrangement in which the handle portion can be held in the state in which it tilts at the time of the centrifugal treatment while maintaining the locked state by tilting the handle portion to the opposite side of the unlock position at which the handle portion tilts with respect to the cover main body. In this case, however, if the direction in which the handle portion is tilted is wrong at the time of the centrifugal treatment, an unsealed state is set. The bucket according to the present invention has no such problem, and the reliability of the sealed state is improved.

As shown in FIG. 9, the attachment mechanisms 34 according to this embodiment are located in the two end portions of the bucket body 11 and the two end portions of the cover when viewed from the axial direction of the trunnion pins 5. The handle portion 25 is formed to have an arc-shaped cross section that is convex toward the opposite side of the bucket body 11 when viewed from the axial direction. Consequently, the interval between the handle portion 25 and the rotor yoke 2 does not change largely at the time of the centrifugal treatment. Therefore, according to this embodiment, the handle portion 25 can be formed by making full use of the limited space between the opening 11*a* of the bucket body 11 and the rotor yoke 2. Note that if the internal space of the bucket body 11 or the handle concave portion 36 can be formed to be sufficiently wide, the upper plate 25*a* of the handle portion 25 need not be formed in an arc shape.

The vertical wall 35 that connects the lid portion 24 and the handle portion 25 is provided inside the handle concave portion 36 (on the bottom of the handle concave portion 36) according to this embodiment. Since, therefore, the vertical wall 35 reinforces the handle portion 25, the handle portion 25 is never deformed even if the centrifugal force is applied to the handle portion 25. Thus, the rigidity of the cover main body 21 is kept high, thereby making it possible to further improve the sealability during the centrifugal treatment. Note that if the strength of the upper plate 25*a* of the handle portion 25 against the centrifugal force can be sufficiently ensured, the vertical wall 35 can be eliminated. If no vertical wall 35 is provided, there is no upward force transmitted from the handle portion 25 to the upper wall 24*b* of the lid portion 24, and thus the sealability is readily ensured.

Each attachment mechanism 34 according to this embodiment includes the clip 23 pivotably supported by the cover main body 21, and the engaging convex portion 14 provided in the bucket body 11 and engaged with the clip 23. Therefore, it is possible to readily switch, by the clips 23, between the locked state in which the cover main body 21 is fixed to the bucket body 11 and the unlocked state in which the fixing is canceled. It is thus possible to provide a bucket for the swinging rotor of a centrifugal separator that is easier to handle.

As described in this embodiment, if the clips 23 are used to fix the cover main body 21 to the bucket body 11, the positions of the clips 23 are apparently different between the locked state and the unlocked state, and it is thus possible to prevent an error operation by the operator. Note that the attachment mechanism 34 is not limited to that using the clip 23 described in this embodiment. Any structure that can detachably fix the cover main body 21 to the bucket body 11 is used.

EXPLANATION OF THE REFERENCE NUMERALS AND SIGNS

1 . . . bucket, 2 . . . rotor yoke, 5 . . . trunnion pin, 11 . . . bucket body, 15 . . . bucket hook groove (engaging portion), 17 . . . tube, 21 . . . cover main body (cover), 22 . . . packing (seal member), 23 . . . clip (clip type fixing tool), 24 . . . lid portion, 25 . . . handle portion, 31 . . . clip fixing portion (pressed portion), 34 . . . attachment mechanism, 35 . . . vertical wall (wall), 36 . . . handle concave portion (hole), 46 . . . clip hook portion

The invention claimed is:

1. A bucket for a swinging rotor of a centrifugal separator, comprising:

a bucket body in a bottomed cylindrical shape configured to accommodate a tube containing a sample to undergo a centrifugal treatment and pivotably and detachably supported by a rotor yoke of the centrifugal separator;

a cover detachably attached to an opening of the bucket body and configured to close the opening;

a seal member provided between the bucket body and the cover; and a pair of attachments provided at positions that divide the opening into two parts and configured to detachably attach the cover to the bucket body while the cover is pressed toward the bucket body, the cover including a lid portion including a pair of pressed portions that are pressed by the pair of attachments and configured to cover the opening, and a handle portion formed integrally with the lid portion and projecting from the lid portion toward an opposite side of the bucket body, the handle portion being stretched between the pair of pressed portions, a hole formed between the lid portion and the handle portion, the hole opening toward the outside of the cover and separating the lid portion and the handle portion, and a wall, in the hole, configured to connect the lid portion and the handle portion stretched between the pair of pressed portions.

2. The bucket for the swinging rotor of thecentrifugal separator according to claim 1, wherein the attachments are located in two end portions of the bucket body and two end portions of the cover when viewed from an axial direction of trunnion pins that are configured to pivotably connect the bucket body to the rotor yoke, and the handle portion is formed to have an arc-shaped cross section that is convex toward the opposite side of the bucket body.

3. The bucket for the swinging rotor of the centrifugal separator according to claim 1 or claim 2, wherein each of the attachments includes a clip type fixing tool that is pivotably supported by one member among the bucket body and the cover, and an engaging portion that is provided in the other member among the bucket body and the cover and engages with the clip type fixing tool.

* * * * *